US005533327A

United States Patent [19]

Albert

[11] Patent Number: 5,533,327

[45] Date of Patent: Jul. 9, 1996

[54] PREFORMING HEAD FOR MAKING ROPES AND CABLE ARMOR

[75] Inventor: Eckehard Albert, Berlin, Germany

[73] Assignee: Witels Apparate-Maschinen Albert GmbH & Co KG, Berlin, Germany

[21] Appl. No.: 234,569

[22] Filed: Apr. 28, 1994

[30] Foreign Application Priority Data

Apr. 29, 1993 [DE] Germany ..... 43 14 172.2

[51] Int. Cl.[6] ..... D01H 13/26; D02G 3/36

[52] U.S. Cl. ..... 57/311; 29/33 F; 57/9; 57/138; 57/361; 140/149

[58] Field of Search ..... 57/9, 311, 138, 57/64, 3, 361; 29/33 F, 779, 745; 140/149

[56] References Cited

U.S. PATENT DOCUMENTS

| | | | |
|---|---|---|---|
| 1,945,799 | 2/1934 | Blamire . | |
| 2,476,180 | 7/1949 | Charles | 57/311 |
| 2,497,178 | 2/1950 | McNamee | 57/311 |
| 2,556,164 | 6/1951 | Carleton et al. | 57/311 |
| 2,724,944 | 11/1955 | Carleton et al. | 57/311 |
| 2,757,506 | 8/1956 | Beck et al. | 57/361 |
| 4,604,861 | 8/1986 | Matsuura et al. | 57/311 |
| 5,052,450 | 10/1991 | Williams | 140/149 |

FOREIGN PATENT DOCUMENTS

| | | | |
|---|---|---|---|
| 736140 | 11/1932 | France | 140/149 |
| 1510164 | 9/1965 | Germany . | |
| 4-2892 | 1/1992 | Japan | 57/311 |
| 1044698 | 9/1983 | U.S.S.R. | 57/6 |

*Primary Examiner*—William Stryjewski
*Attorney, Agent, or Firm*—Collard & Roe

[57] ABSTRACT

A preforming head for making ropes and cable armor including an axle with a front preforming disk fixedly mounted thereon. A middle preforming disk and a rear preforming disk are displaceably mounted on the axle. The middle disk has a diameter larger than the front disk and smaller than the rear disk. A drive moves the disks so that the distance between front disk and middle disk remains approximately equal to the distance between middle disk and rear disk.

9 Claims, 2 Drawing Sheets

PREFORMING HEAD FOR MAKING ROPES AND CABLE ARMOR

BACKGROUND OF THE INVENTION

1. Field of the Invention

The present invention relates to a preforming head for ropes and cable armor. More specifically, it relates to a preforming head with three variously sized disks mounted on an axle. Two of the disks are movable along the axle by a drive which always maintains specified distances between the three disks.

2. The Prior Art

Preforming heads are known, for example, from U.S. Pat. No. 2,476,180 entitled "Apparatus for Making Wire Rope of Preformed Flattened Strands". In the manufacture or laying of ropes or cable armor with different strand lengths, the spacing between the disks has to be adjustable whereby the distance between adjacent disks is the same. The known preforming heads are adjusted by hand and, due to the play in each disk, the disks are not always centered relative to each other. As a result, significant time and effort is expended in measuring and adjusting the disks.

SUMMARY OF THE INVENTION

It is, therefore, an object of the present invention to overcome the drawbacks of the prior art and to provide a preforming head which can be simply and easily adjusted.

It is a further object of the present invention to provide a preforming head in which the disks can be rapidly yet precisely adjusted by a single mechanical control.

These and other related objects are achieved according to the invention by a preforming head for making ropes and cable armor including an axle with a front preforming disk fixedly mounted thereon. A middle preforming disk and a rear preforming disk are displaceably mounted on the axle. The middle disk has a diameter larger than the front disk and smaller than the rear disk. Means for moving the disks are provided so that a first distance, between the front disk and the middle disk, remains approximately equal to a second distance, between the middle disk and the rear disk. The front disk is accordingly moved twice as far as the middle disk, with respect to the rear disk.

The axle is a tube with the front disk coaxially mounted at one end thereof. The preforming head further includes a first gear rack fixedly attached to a tube and a second gear rack movably connected to the tube and disposed parallel to the first gear rack. The middle disk is mounted on an end of a second gear rack that is closest to the front disk. A gear engages each gear rack and both gears are rotatably supported on the rear disk. A transmission couples the gears together and drive means rotates one of the gears.

The first gear rack is formed in an outer surface of the tube and the second gear rack is disposed within a groove on the tube. An axle is provided for rotatably supporting each gear. A bevel gear is mounted on each axle. The axles are oriented at 90° to each other, and the racks are located 90° from each other around a circumference of the tube. The gear engaging the second gear rack has twice as many teeth as the gear engaging the first gear rack. A central annular flange is connected to the second gear rack. The middle disk is adjustably mounted on the central annular flange.

A housing is formed adjacent a side of the rear disk facing away from the front and middle disks. The housing also encloses a section of the tube. The gears, the axles, the bevel gears and the transmission are all disposed within the housing. The drive means includes an extension that extends outwardly of the housing and may also include a hand crank or a motor. A roller is tangentially journaled on each of the disks for engaging the ropes and cable armor.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
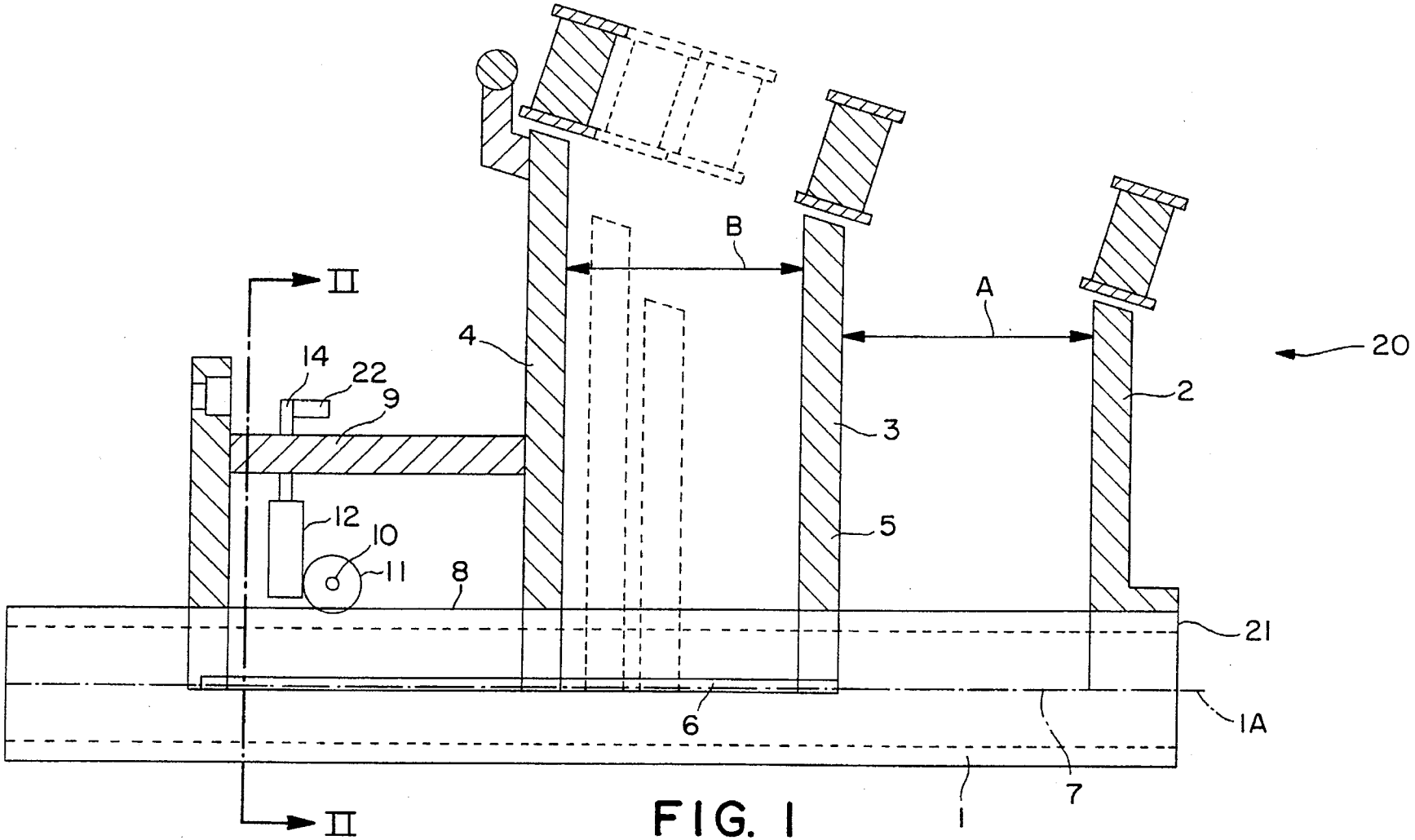
FIG. 1 is a left-side elevational view, in part cross section, of an embodiment of a preforming head of the invention.

Turning now in detail to the drawings, and in particular to FIG. 1, there is shown a preforming head 20 having an axle or tube 1 and three disks 2, 3 and 4, with different diameters, mounted thereon. A roller is journaled tangentially on each disk. A small front disk 2 is rigidly mounted on a front end 21 of tube 1. A middle disk 3, having a diameter larger than disk 2, is adjustably arranged on an inner annular flange 5. This arrangement provides for fine adjustment in a manner known by those skilled in the art. Annular flange 5 is rigidly joined at its bottom end to a gear rack 6. Gear rack 6 is slidably disposed within a correspondingly sized groove 7 formed in a wall of tube 1, for example the exterior wall, as shown in FIGS. 2 and 4.

A further gear rack 8 is embedded in tube 1 parallel to groove 7 and located 90° around tube 1 from groove 7. Gear rack 8 may be cut into the wall of he tube, or may be a finished gear track fastened within a groove or directly on tube 1. A housing 9 is rigidly connected to the rear side of disk 4 facing away from disk 3. Tube 1 and attached gear rack 8 are slidable, along a longitudinal axis 1A of tube 1, within a correspondingly sized circular aperture within disk 4 and housing 9.

Figure 3:
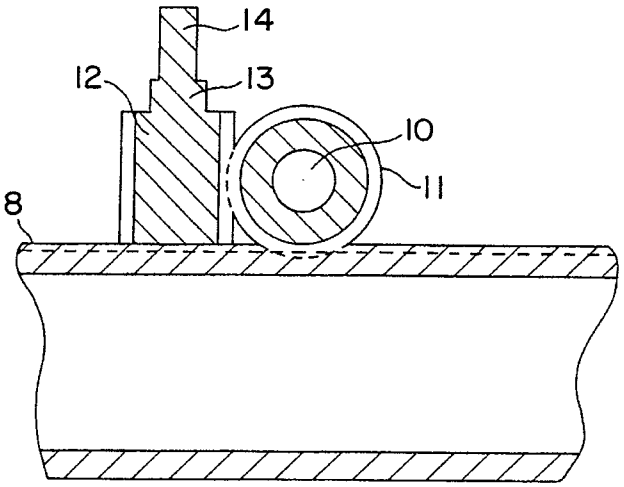
FIG. 3 is a cross sectional view, taken along the lines III—III of FIG. 2.

A gear 11, which is rotatably mounted on an axle 10, engages gear track 8 within housing 9. A worm gear 12 is rotatably supported by housing 9 and mates with gear 11. An axle 13 of worm gear 12 includes an extension 14, as can be seen in FIGS. 2 and 3, that extends outwardly of housing 9, as can be seen in FIG. 1. Extension 14 may be provided with a polygonal cross section for rotation by a correspondingly shaped element 22, for example, a hand crank, a spanner, or a motor. By turning extension 14, worm gear 12 rotates gear 11 to move gear rack 8 and tube 1 through the center of disk 4 to alter the distance between disk 2 and disk 4.

Figure 4:
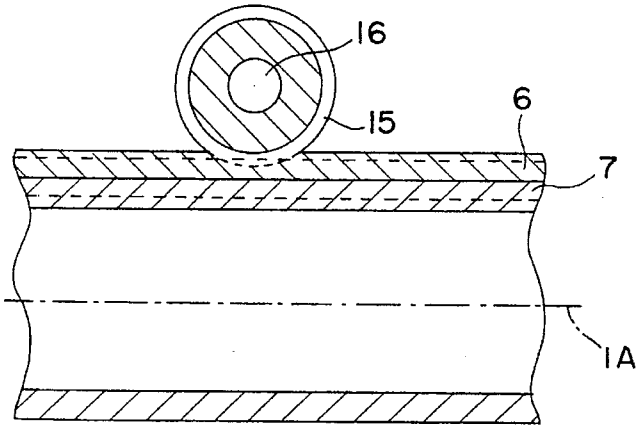
FIG. 4 is a cross sectional view, taken along the lines IV—IV of FIG. 2.
Figure 2:
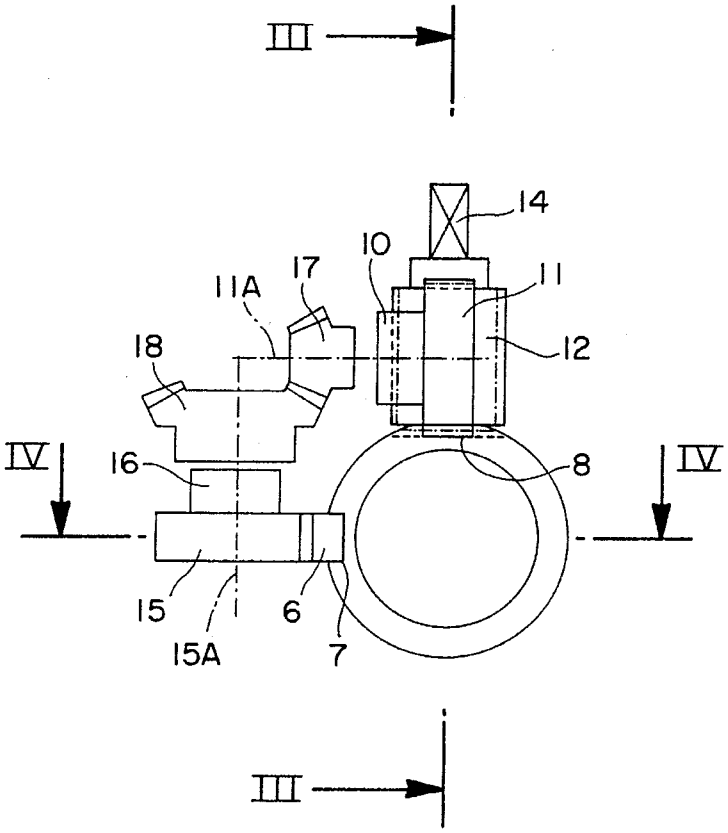
FIG. 2 is a rear elevational view of the embodiment of FIG. 1, taken along the lines II—II of FIG. 1.

As can be seen in FIGS. 2 and 4, a gear 15 is mounted on an axle 16 rotatably mounted within housing 9. The central axis of gear 15A and axle 16 is disposed at a 90° angle to the central axis 11A of gear 11 and axle 10. Both central axes 15A and 11A are disposed in a plane oriented perpendicular to the longitudinal expanse of tube 1. Gear 15 engages gear rack 6. Rotation of gear 15 displaces rack 6 within groove 7. Movement of gear rack 6, which is connected to middle disk 3, is independent of tube 1.

Axle 16 and axle 10 each support a bevel gear 18 and 17, respectively. Bevel gear 18 has twice as many teeth as bevel gear 17. Bevel gears 17 and 18 engage each other within housing 9.

Due to the kinetic connection between bevel gears 17 and 18, a drive that rotates extension 14 causes disks 2 and 3 to be simultaneously displaced in the same direction. Because of the 2:1 gear ratio between bevel gears 18 and 17, disk 2 moves at twice the speed of disk 3. In an initial position, the distance A between disks 2 and 3 is equal to the distance B between disks 3 and 4. Coordinated adjustment with precise maintenance of distance A equaling distance B is simply achieved by turning extension 14. A motor 22 optionally engages extension 14 to achieve remote control of the disk movements.

While only a single embodiment of the present invention has been shown and described, it is to be understood that many changes and modifications may be made thereunto without departing from the spirit and scope of the invention as defined in the appended claims.

What is claimed is:

1. A preforming head for making ropes and cable armor, comprising: an axially-extending tube with an end;

a front preforming disk fixedly and coaxially mounted on said end;

a middle preforming disk and a rear preforming disk displaceably mounted on said tube, said middle disk having a diameter larger than the front disk and smaller than the rear disk; and means for moving said middle and rear disks relative to said front disk and said tube so that a first distance, between the front disk and the middle disk, remains substantially equal to a second distance, between the middle disk and the rear disk, wherein said rear disk is moved twice as far as said middle disk, said means for moving comprising:

(i) a first gear rack fixedly attached to said tube;

(ii) a second gear rack movably connected to said tube and disposed parallel to said first gear rack, said middle disk being mounted on an end of said second gear rack closest to said front disk;

(iii) a gear engaging each of said first and second gear racks, the gears being rotatably supported on said rear disk;

(iv) a transmission coupling said gears together; and (v) drive means for rotating one of the gears.

2. The preforming head according to claim 1, wherein said first gear rack is formed in an outer surface of said tube, and said second gear rack is disposed within a groove on said tube.

3. The preforming head according to claim 2, further including:

an axle supporting each gear; and a bevel gear mounted on each axle, wherein the axles are oriented at 90° to each other and the racks are located at 90° from to each other and around a circumference of the tube, and wherein the gear engaging said second gear rack has twice as many teeth as the gear engaging the first gear rack.

4. The preforming head according to claim 3, further comprising a central annular flange coupled to said second gear rack, wherein said middle disk is adjustably mounted on said central annular flange.

5. The preforming head according to claim 4, further comprising a housing formed adjacent a side of said rear disk facing away from said front and middle disks, said gears, said axles, said bevel gears and said transmission all being disposed within said housing.

6. The preforming head according to claim 5, wherein said drive means includes an extension that extends outwardly of said housing.

7. The preforming head according to claim 6, wherein said drive means includes a hand crank for rotating said extension.

8. The preforming head according to claim 6, wherein said drive means includes a motor for rotating said extension.

9. The preforming head according to claim 8, further comprising a roller journaled tangentially on each of said disks for engaging the ropes and cable armor.

* * * * *